United States Patent [19]

Mueller et al.

[11] 3,944,041

[45] Mar. 16, 1976

[54] CHANGEABLE TYPE

[75] Inventors: Hans W. Mueller; Cornel L. Lamey, both of Cortland, N.Y.

[73] Assignee: SCM Corporation, New York, N.Y.

[22] Filed: June 21, 1974

[21] Appl. No.: 481,605

[52] U.S. Cl. ..... 197/36; 197/37

[51] Int. Cl.[2] ..... B41J 1/04

[58] Field of Search ..... 197/17, 36, 37; 24/132 WL, 24/134 KB

[56] References Cited

UNITED STATES PATENTS

| | | | |
|---|---|---|---|
| 1,206,972 | 12/1916 | Anderson | 197/36 |
| 2,171,470 | 8/1939 | Munoz | 197/36 |
| 2,530,879 | 11/1950 | Hendrickson | 24/134 KB |
| 3,263,792 | 8/1966 | Snyder | 197/36 |
| 3,308,916 | 3/1967 | Canny et al. | 197/36 |
| 3,432,018 | 3/1969 | Tomoyosh et al. | 197/36 |

*Primary Examiner*—Edgar S. Burr
*Assistant Examiner*—Paul J. Hirsch
*Attorney, Agent, or Firm*—Stanley J. Klem; Milton M. Wolson

[57] ABSTRACT

A changeable type element for typebars of a typewriter is disclosed comprising a U-shaped member having a pair of walls spaced from one another by a connecting type face. The type element is multipositional within the typebar segment of the typewriter. A camming means is pivotally supported between the spaced walls. A spring, attached to the camming means biases the camming means into locking engagement with the typebar when the type element is assembled on the free end of the typebar. The spring compensates for any wear on the camming means to prevent the camming means from disengaging from the typebar. The type element is thereby prevented from flying off the typebar when the typebar is in flight or from becoming loose from repeated printing operations.

14 Claims, 6 Drawing Figures

CHANGEABLE TYPE

BACKGROUND OF THE INVENTION

The present invention relates to typewriters, and more particularly to a changeable type element which may be removably mounted on a typebar.

Known prior art changeable type elements for typebars have incorporated locking devices to prevent the type element from becoming disengaged from a typebar and from being propelled from the typebar while in flight.

For example, one known changeable type element, shown in U.S. Pat. No. 1,090,597 to S. D. Busz, incorporated a hollow open ended type element with type characters embossed on opposite faces that connected the walls. The type element was placed upon a preformed portion of the typebar and locked in position by a pivotal arm. The pivotal arm included an overlying detent portion that engaged a recess in the top of the type element. The centrifugal force of the typebar during flight forced the type element against the detent portion of the pivotal arm and was prevented from disengaging. If the detent portion of the pivotal arm became deformed, the detent portion could disengage from the type element. If this happended and the typebar was in flight, the type element would dislodge from the typebar and fly off.

Other changeable type devices, such as that shown in U.S. Pat. No. 3,308,916 to F. H. Canny et al., included a U-shaped changeable type element having a single font bearing surface. A projecting abutment on its rear surface engaged a recess in the typebar as the type element was assembled on the typebar. A spring attached to the type element biases the type element into engagement with the typebar. Excessive shock during impact of the type element against the platen may overcome the biasing effect of the spring and the type element may dislodge from the typebar and fly off.

None of the prior art included means to compensate for wear on the engageable parts as the present invention does.

SUMMARY OF THE INVENTION

According to the present invention, there is provided a changeable type element for easily assembling on and removing from the free end of a typebar. The type element includes a pair of walls spaced from one another by a connecting type face that has at least one character embossed thereon. An abutment projects from the rear surface of the type face for engagement with a slot in the typebar for aligning the type element on the typebar. The type element is provided with a camming member supported on a pivot that spans the spaced walls. A spring urges the camming member into continued locking engagement with the typebar when the type element is assembled on the free end of the typebar.

Accordingly, an object of the present invention is to provide a changeable type element that includes a spring biased cam means to compensate for wear while maintaining a positive lock assembly.

Another object of the present invention is to provide a changeable type element that can easily be installed and removed from the free end of a typebar.

Another object of the present invention is to provide a changeable type element that is positively locked on the free end of the typebar by a spring biased cam means.

A further object of the present invention is to provide a changeable type element where the typebar carrying the changeable type element can occupy any position in the typebar segment of a typewriter.

Other objects, features, and advantages of the invention will become more apparent from the following description, appended claims, and accompanying drawings.

DESCRIPTION OF THE PREFERRED EMBODIMENT

Figure 1:
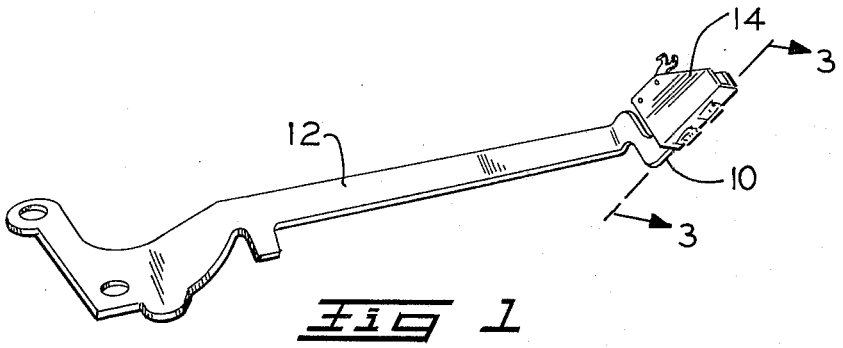
FIG. 1 is a perspective view showing the improved changeable type element assembled on a typebar according to the present invention.
Figure 2:
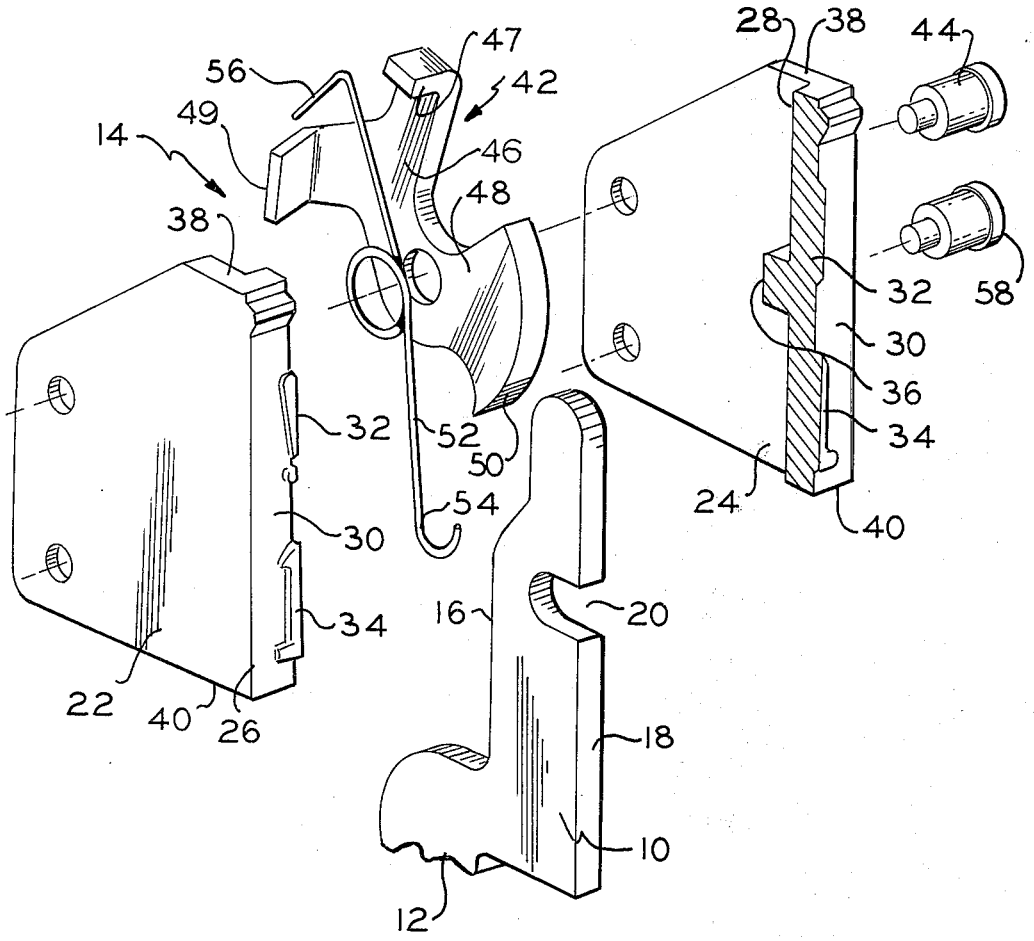
FIG. 2 is an exploded perspective view of the type element showing its construction.

Referring now to the drawings, and more particularly to FIG. 2 showing a free end 10 of a typebar 12 and the type element 14 disassembled.

Typebar 12 includes a rear surface 16, and a front surface 18 that has a notch 20 spaced from the end of the typebar.

Type element 14 includes a pair of spaced walls 22 and 24 that are connected by a type font carrying front face wall 26. Front face wall 26 has a rear surface 28 and a front surface 30. Front surface 30 has a pair of type characters 32 and 34 embossed thereon. Rear surface 28 has an abutment 36 projecting therefrom. Abutment 36 is spaced intermediate a top 38 and a bottom 40 of type element 14 and engages typebar notch 20 when type element 14 is assembled to typebar 12.

Figure 4:
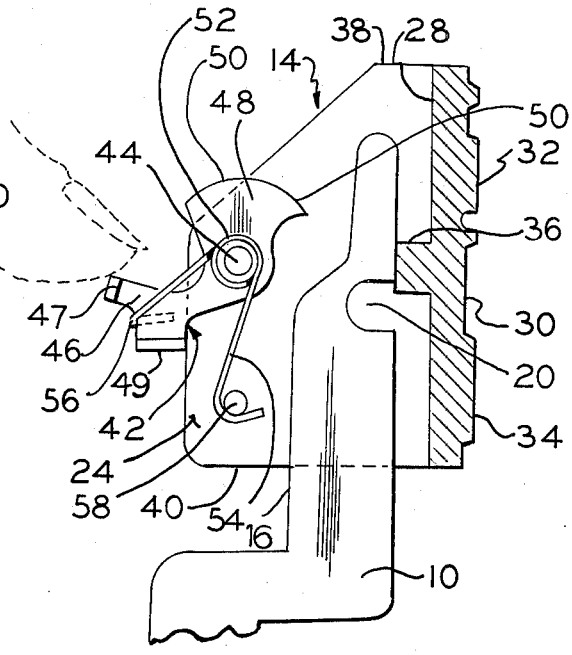
FIG. 4 is a section view similar to FIG. 3 showing the typebar and type element in position just prior to engagement.
Figure 5:
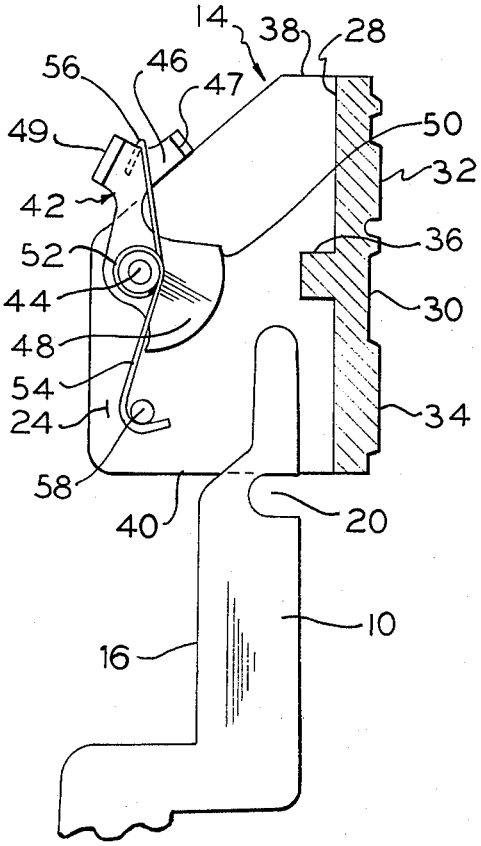
FIG. 5 is a section view similar to FIG. 3 showing the camming member in its rest position when the type element is removed from the typebar.
Figure 6:
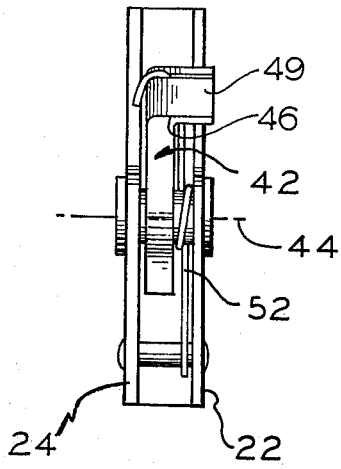
FIG. 6 is a rear elevational view of the type element.

A camming lever 42 is pivotally supported on a pivot member 44 that spaces wall 22 and 24. Camming lever 42 includes a lever portion 46 and a body portion 48. Body portion 48 includes a cam surface 50. Lever portion 46 includes a stop tab 47. Stop tab 47, as shown in FIG. 5, abuts a portion of wall 22 to prevent excessive rotation of camming lever 42 when type element 14 is disassembled from typebar 12. Lever portion 46 also includes a second stop tab 49. Stop tab 49, as shown in FIG. 4, abuts a portion of wall 22 to limit the rotation of camming lever 42 in the typebar release direction.

Cam surface 50 is spaced relative to pivot member 44. Pivot member 44 is in horizontal alignment with abutment 36 to insure maximum locking engagement between camming lever 42 and free end 10. In other words, maximum locking engagement occurs when camming lever 42 is rotated in a typebar engaging direction and cam surface 50 engages typebar surface 16. The locking force is exerted against surface 16 at a point between and in line with the center of pivot member 44 and the center of abutment 36.

A torsion spring 52 having opposite extensions 54 and 56 is supported about pivot member 44. One extension 54 extends downward and behind a pin 58 that spans the distance between the spaced walls 22 and 24.

Extension 56 extends upward and is hooked over the base of lever portion 46 of camming lever 42. Spring 52 biases camming lever 42 in a clockwise direction as viewed in the drawings. In other words, when element 14 is assembled to free end 10, spring 52 rotatably biases cam surface 50 into a progressive locking engagement with rear surface 16 of typebar 12. Because of the locking engagement of cam surface 50 and typebar 12, notch 20 and abutment 36 are prevented from disengaging.

Figure 3:
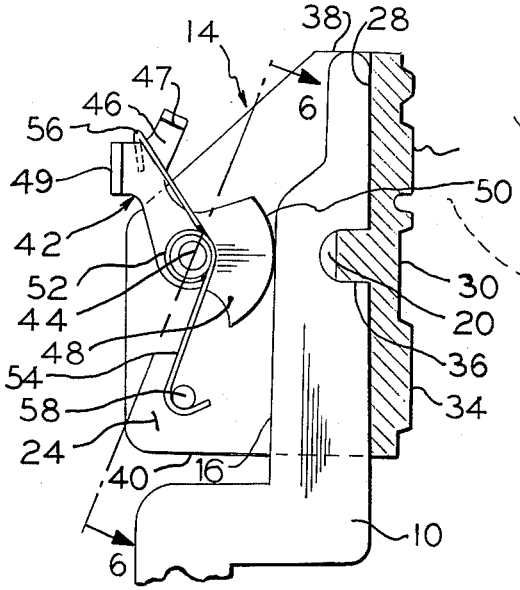
FIG. 3 is a section view taken along line 3—3.

In operation, type element 14 is assembled to the typebar in the following manner as shown in FIGS. 3 and 4. Camming lever 42 is first manually pivoted out of the typebar entrance area of type element 14. Then type element 14 is positioned over free end 10 of typebar 12. Then type element 14 is lowered onto free end 10. Notch 20 and abutment 36 are aligned at which time type element 14 is moved rearward. Abutment 36 is then fully engaged with notch 20 as shown in FIG. 3. At this time, camming lever 42 is released. Spring 52 then biases cam surface 50 to progressively engage rear surface 16 of free end 10. The force exerted against rear surface 16 of typebar 12 by spring biased cam 42 positively locks type element 14 on typebar 12. As typebar 12 is actuated by depressing a selected key (not shown), and type element 14 impacts a printing platen (not shown), the shock sustained by type element 14 may be so severe so as to jar and possibly loosen the engagement between type element 14 and typebar 12. In that event, spring 52 biases camming lever 42 into further engagement with typebar 12 to prevent type element 14 from flying off typebar 12.

After continuous use, the locking mechanism of type element 14 may wear. Specifically, cam surface 50 may develop a flat area where cam surface 50 engages typebar 16. If this occurs, the locking engagement between type element 14 and typebar 16 may loosen. Type element 14 may dislodge from typebar 12 and fly off. To compensate for the wear on cam surface 50, spring 52 biases camming lever 42 into still further engagement with typebar 12. Therefore, any looseness between type element 14 and typebar 12 is compensated for by the biasing effect of spring 52 on cam surface 50.

When it is desired to remove type element 14 and install a new element, camming lever 42 is again manually pivoted out of the typebar entrance area of type element 14. Then type element 14 is rocked free until abutment 36 and notch 20 are disengaged. Type element 14 is then removed. The new type element is then installed.

While the foregoing description has shown and described the fundamental novel features as applied to a preferred embodiment, it will be understood by those skilled in the art that modification embodied in various forms may be made without departing from the spirit and scope of the invention.

We claim:

1. An improved changeable type element for mounting on the free end of a typebar, the type element having a pair of walls spaced from one another by a connecting type face wall defining a U-shaped type element, the improvement comprising:

a. a pivot member supported on the type element;

b. a first means supported on said pivot member for selectively and progressively wedging against said typebar when said element is mounted on the typebar; and c. a second means separate from said first means and operatively engaging said first means for biasing said first means into progressive wedging engagement with the typebar thereby compensating for wear on said first means.

2. A changeable type element as defined in claim 1 wherein said first means includes a surface spaced relative to said pivot member for progressively engaging the free end of the typebar to the locking engagement position as the type element is assembled on the typebar.

3. A changeable type element as defined in claim 1 wherein the rear surface of the type face has a projecting abutment and wherein the axis of said pivot member is horizontally aligned with said projecting abutment for maximum locking engagement between said first means and the free end of the typebar.

4. A changeable type element as defined in claim 1 wherein said first means includes a lever portion having an abutment thereon for preventing rotation of said first means beyond a predetermined position in a locking direction as the type element is disassembled from the free end of the typebar.

5. A changeable type element as defined in claim 1 wherein said second means means includes a spring having a pair of extensions radially projecting from said pivot member, one of said extensions engages said first means and the other of said extensions engages a portion of said type element thereby urging said first means to rotate into engagement with the typebar.

6. A changeable type element as defined in claim 5 wherein the type element includes a pin fixed between the spaced walls and spaced from said pivot member for engagement by said other extension of said spring.

7. A changeable type element as defined in claim 1 wherein said pivot member spans the distance between the pair of spaced walls of the type element.

8. An improved changeable type element for mounting on the free end of a typebar, the type element having a pair of walls spaced from one another by a connecting type face wall defining a U-shaped type element, the improvement comprising:

a pivot member spanning the distance between and supported by the pair of spaced walls;

a first means supported on said pivot member and pivotal between the pair of spaced walls; and a second means supported on said pivot member and located between the spaced walls of the type element separate from said first means and operatively engaging said first means for biasing said first means into progressive wedging engagement with the typebar thereby compensating for wear on said first means.

9. A changeable type element as defined in claim 8 wherein said first means includes a surface spaced relative to said pivot member for progressively engaging the free end of the typebar to the locking engagement position as the type element is assembled on the typebar.

10. A changeable type element as defined in claim 8 wherein the rear surface of the type face has a projecting abutment and wherein the axis of said pivot member is horizontally aligned with said projecting abutment for maximum locking engagement between said first means and the free end of the typebar.

11. A changeable type element as defined in claim 8 wherein said first means includes a lever portion having an abutment thereon for preventing rotation of said first means beyond a predetermined position in a locking direction as the type element is disassembled from the free end of the typebar.

12. A changeable type element as defined in claim 8 wherein said second means means includes a spring having a pair of extensions radially projecting from said pivot member, one of said extensions engages said first means and the other of said extensions engages a portion of said type element thereby urging said camming means to rotate into engagement with the typebar.

13. A changeable type element as defined in claim 12 wherein the type element includes a sin fixed between the spaced walls and spaced from said pivot member for engagement by said other extension of said spring.

14. An improved changeable type element for mounting on the free end of a typebar, the type element having a pair of walls spaced from one another by a connecting type face wall defining a U-shaped type element, the improvement comprising:

an eccentric wedge member pivotally supported for rotational movement on said type element whereby said member may be rotated to progressively increase the wedge pressure against said typebar; and a wear compensating means separate from said wedge member and operatively engaging said wedge member for biasing said member for rotating into wedging relationship with said typebar.

* * * * *